US005541636A

United States Patent [19]

Ingram

[11] Patent Number: 5,541,636

[45] Date of Patent: Jul. 30, 1996

[54] THERMAL TRANSFER APPARATUS FOR FUSING PRINT DYE ON A MEDIA

[75] Inventor: Glenn B. Ingram, Boise, Id.

[73] Assignee: Hewlett-Packard Company, Palo Alto, Calif.

[21] Appl. No.: 253,050

[22] Filed: Jun. 2, 1994

[51] Int. Cl.[6] ..... B41J 29/00

[52] U.S. Cl. ..... 347/212; 355/285; 355/289; 355/290; 347/102

[58] Field of Search ..... 347/156, 102, 347/212; 355/282, 285, 286, 287, 288, 289, 290, 291; 219/216

[56] References Cited

U.S. PATENT DOCUMENTS

| | | | |
|---|---|---|---|
| 3,219,799 | 11/1965 | Trumbull et al. | 355/291 |
| 4,034,189 | 7/1977 | Sakamaki | 347/156 |
| 5,155,503 | 10/1992 | Tasaki et al. | 347/102 |
| 5,411,825 | 5/1995 | Tam | 347/156 |

FOREIGN PATENT DOCUMENTS

| | | | |
|---|---|---|---|
| 0538071 | 4/1993 | European Pat. Off. | 347/102 |
| 0201342 | 7/1992 | Japan | 347/102 |
| 0031892 | 2/1993 | Japan | 347/102 |
| 0042670 | 2/1993 | Japan | 347/102 |
| 0050706 | 3/1993 | Japan | 347/102 |
| 0112001 | 5/1993 | Japan | 347/102 |
| 0111999 | 5/1993 | Japan | 347/102 |
| 0112000 | 5/1993 | Japan | 347/102 |
| 0079868 | 3/1994 | Japan | 347/102 |

*Primary Examiner*—Huan H. Tran

[57] ABSTRACT

A thermal apparatus for fusing print dye onto print media in a hard copy machine is disclosed. A medium bearing a "wet" image, such as text or graphics in ink or toner, is fed by the machine into the apparatus. Sensing the presence of the medium, the heater element(s) of the apparatus are activated. As the medium is fed into the apparatus, the toner or ink is at least partially fixed to the medium prior to its leading edge reaching transport rollers of the apparatus which grab the medium in a nip to continue its path through and out of the apparatus. The heater element(s) are turned off when the trailing edge of the medium is sensed. The heater is a laminated device. Grooves are provided on the face of the heater proximate the medium path in order to improve heat transfer from the device to fix the image.

22 Claims, 2 Drawing Sheets

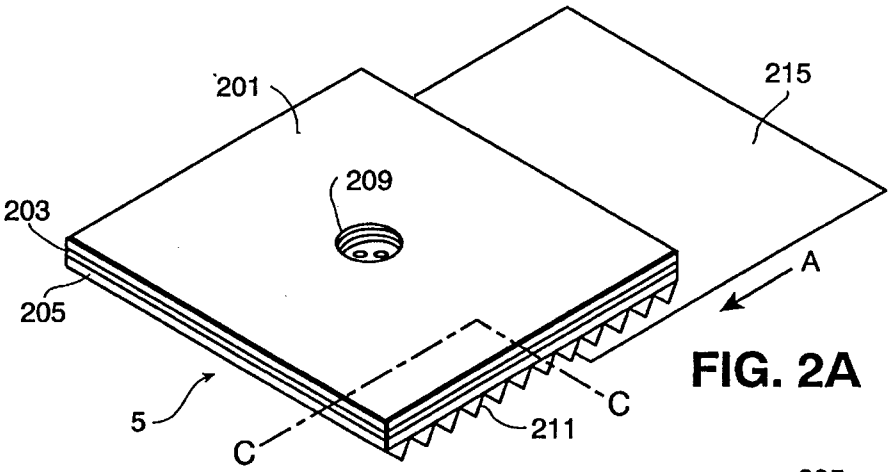
FIG. 2A
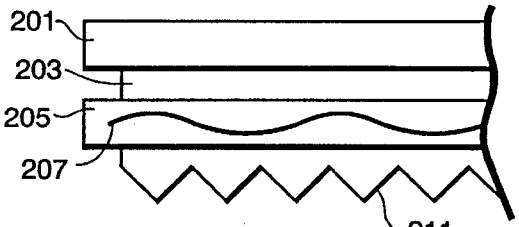
FIG. 2B
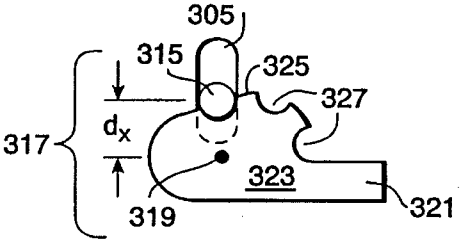
FIG. 4A
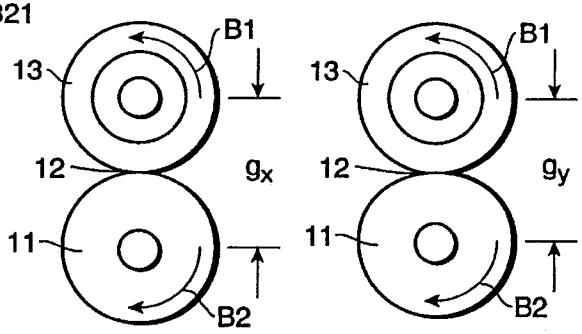
FIG. 4C
FIG. 4D
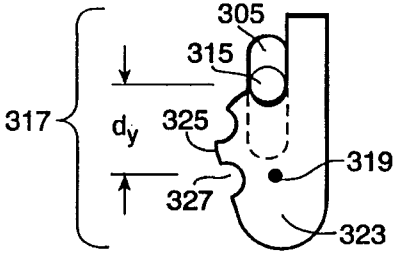
FIG. 4B
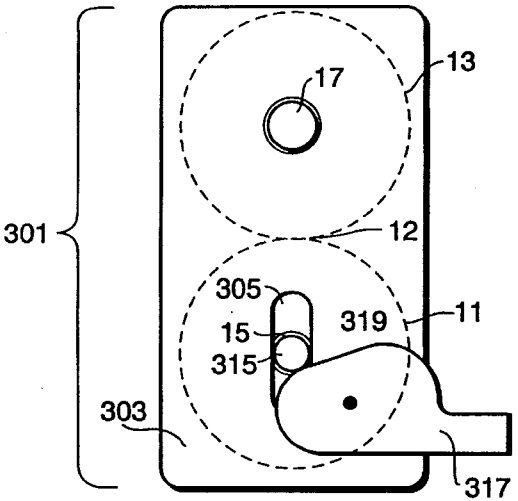
FIG. 3

THERMAL TRANSFER APPARATUS FOR FUSING PRINT DYE ON A MEDIA

FIELD OF THE INVENTION

The present invention relates generally to hard copy production, more particularly to machines such as computer printers and plotters, copiers, facsimiles and the like, and, more specifically, to a fusion heater for processing images on print media.

BACKGROUND OF THE INVENTION

In the field of hard copy production, key performance specifications are print quality and throughput, that is, trying to achieve the highest number of copies per unit of time while maintaining print copy quality.

Many inks, dyes, toners, and the like used in the production of hard copy are of a liquid base. This causes a problematical phenomenon known as paper cockle. For example, when the liquid ink is deposited on a wood-based paper, the paper absorbs the ink into the cellulose fibers and causes the fibers to swell. As the fibers swell, they generate localized expansions which in turn cause the paper to warp uncontrollably in these regions. The final printed sheet of paper is unacceptably wrinkled. This problem crosses printing hardware technology boundaries.

In electrophotography, a latent image on a charged surface area of a photoconductor is developed, by application of an electroscopic toner to the area. The developed image is transferred to a hard copy medium, e.g., paper. (For ease of explanation, plain paper will be used as an exemplary print medium hereinafter; however, as will be recognized by a person skilled in the art, the invention described herein is applicable to all forms of hard copy media such as papers, transparencies, envelopes, and the like, and no limitation on the scope of the invention is intended nor should any be implied.) Both wet toner chemicals and dry toner powders are known to be used to develop the image. Heat fusible toner particles are used in liquid developers. The image is then fixed, that is, fused to the paper.

This same electrophotography construct generally applies to printers (HP and Laser Jet are registered trademarks of Hewlett-Packard Company, Palo Alto, Calif.).

In ink-jet hard copy production, text or graphics is produced by scanning a printhead across the paper. The printhead, which in combination with an ink reservoir is sometimes referred to as the ink-jet pen, includes a nozzle plate combined with resistors and drive circuitry. The resistors are used to momentarily boil ink to eject microscopic droplets of ink from the pen onto the paper in a dot matrix configuration to generate the text or graphics. The ink is generally in a liquid form when it first contacts the paper. The carrier fluid evaporates, leaving the colorant dot on the paper. With drop per inch ("DPI") density on the paper approaching 1200 DPI, it is important not only for throughput but also for print quality that the droplets dry in an optimal manner.

Thus, a print quality and throughput design requirement for both toner and ink application in hard copy machines is that a finite time to be allotted for drying so that the print will not be smudged if handled prematurely. The problem is even more pronounced when printing or plotting on plastic-based films and transparencies which have slower rates of absorption than paper materials.

In electrophotography and laser printing, it is known to apply heat to the paper during the fusing process (which is why fresh copies from a photocopier feel warm to the touch). For example, a heated roller (typically having a heating element within such as disclosed in U.S. Pat. Nos. 4,952,781 (Kozaiku) and 4,780,078 (Masui), Japanese Patent No. 62-130S864(A)(Mita)) is generally used to apply pressure to the toner on a sheet of paper pulled through the roller at a rate that causes the toner to fuse properly to the paper.

Another method and apparatus for fusing toner into a print medium during laser printing is shown in U.S. patent application Ser. No. 08/132,598 by Ingram (assigned to the common assignee of the present application) filed on Oct. 6, 1993, incorporated herein by reference. In that invention, a high energy laser beam is synchronized with a low energy beam used to develop the latent image. A follower roller is used, if needed, to sustain the laser induced fusion to fix the developed image. While highly successful, this apparatus is relatively complex and costly. Energy from light other types of light sources have also been used. See e.g., Japanese Patent No. 62-109645 (A)(Abe).

In ink-jet technology, various attempts at solution of the problem have been invented. Medin et al. disclose a print zone heater screen in patent application Ser. No. 07/876,942, filed May 1, 1992, U.S. Pat. No. 5,329,295. Richtsmeier et al. disclose a print heater having variable heat energy for different media in patent application Ser. No. 07/876,986, filed May 1, 1992 and continued at Ser. No. 08/137,388. Russell et al. disclose an airflow system for thermal ink-jet printers in patent application Ser. No. 07/876,939, also filed May 1, 1992, U.S. Pat. No. 5,296,873. Richtsmeier et al. also disclose a heater blower system for color printers in patent application Ser. No. 07/876,924, filed May 1, 1992, U.S. Pat. No. 5,428,384. In U.S. Pat. No. 5,287,123, Medin et al. disclose a preheat roller for pre-print thermal treatment of media.

Another problem in the state of the art is that time is generally wasted while known print fusion heaters are brought up to operating temperature, increasing the time to first page printout.

Due to constant operation when the hard copy machine is in service, a further problem is that fusion heaters generally have to be replaced after a certain number of pages of print, mainly due to heating element failure.

Due to the inherent operating nature, fusion heaters can also be considered a fire hazard.

A related problem is created by the changing thicknesses and coefficients of friction of different types of print media, e.g., plain papers, glossy papers, vellums, envelopes, and plastic transparencies. There is a need in hard copy technology for handling different forms of print media transport through mechanisms such as a fusion heater.

In summary, there is a need in hard copy technology for improvements in quick and efficient methods and apparatus for fusing developed images, such as text or graphics made with wet or dry toner or ink (liquid or hot-melt, dye or pigment-based)—collectively and generically referred to hereinafter as "print dye(s)."

SUMMARY OF THE INVENTION

It is an advantage of the present invention that it provides for a quick, efficient means to bring the print dye to its fluid-to-solid transition temperature.

It is another advantage of the present invention that it precisely directs the thermal energy required to raise the print dye to its transition temperature, improving the quality of adhesion.

It is another advantage of the present invention that it improves print quality by drying the print dye before it has time to diffuse in the medium.

Another advantage of the present invention is that it allows for print media of different thicknesses and coefficients of friction.

It is yet another advantage of the present invention that it provides heat sensing to improve control over the print dye fusion process.

It is still another advantage of the present invention that it has minimal, if any, effect on the time to print a page, increasing the "time-to-first-page" printing factor once a computer has processed the data to be printed.

It is an advantage of the present invention that it lowers the risk of creating thermal problems for other components of the hard copy machine in which it resides.

It is a further advantage of the present invention that it will endure for the effective life of the product.

The present invention provides a low cost fusion heater for hard copy machines. In its basic aspect, the present invention has a support table for receiving the print medium in a first plane as said medium is transported by the machine into the apparatus. A detector disposed with respect to said support table generates a first signal indicative of print medium presence when a leading edge of the medium is transported onto the support table and a second signal indicative of print medium absence from said support table when a trailing edge of said medium passes the detector. The signals are used to turn the heater on and off, respectively. A transporting device is disposed with respect to the support table for receiving the leading edge of the medium and transporting the medium across the support table, onward and out of the fusion heater apparatus. A first heater, disposed adjacent said first plane in a second plane parallel thereto, is provided for transferring heat to the print medium in response to the first signal and prior to the medium leading edge reaching the transporting device. The heater is a laminate of an improved design. A serrated face of the laminate is placed near the medium as it is transported along its path through the apparatus which improves thermal transfer from the apparatus to the medium. A supplemental follower heater may also be provided.

Other objects, features and advantages of the present invention will become apparent upon consideration of the following detailed description and the accompanying drawings, in which like reference designations represent like features throughout the FIGURES.

DESCRIPTION OF THE DRAWINGS

FIG. 2A is a perspective view of a planer, fusion heater element of the present invention as shown in FIG. 1, with FIG. 2B being a detail, plan view (side) of a cross-section taken along section line C—C of FIG. 2A.

FIG. 3 is a cutaway, perspective view of an end plate, roller adjustment device and rollers of the apparatus of the present invention as shown in FIG. 1.

FIGS. 4A–4C are is a plan view (side) demonstration of method of operation of the roller adjustment device as shown in FIG. 3 in which:

FIG. 4A is a plan view (side) schematic depiction of the adjustment mechanism in a first position;

FIG. 4B is a plan view (side) schematic depiction of the adjustment mechanism in a second position;

FIG. 4C is a plan view (side) schematic depiction of the rollers of the present invention as shown in FIG. 1 in a position where the rollers form a minimally compressed nip; and FIG. 4D is a plan view (side) schematic depiction of the rollers of the present invention as shown in FIG. 1 in a position where the rollers form a maximum compression nip.

Figure 1:
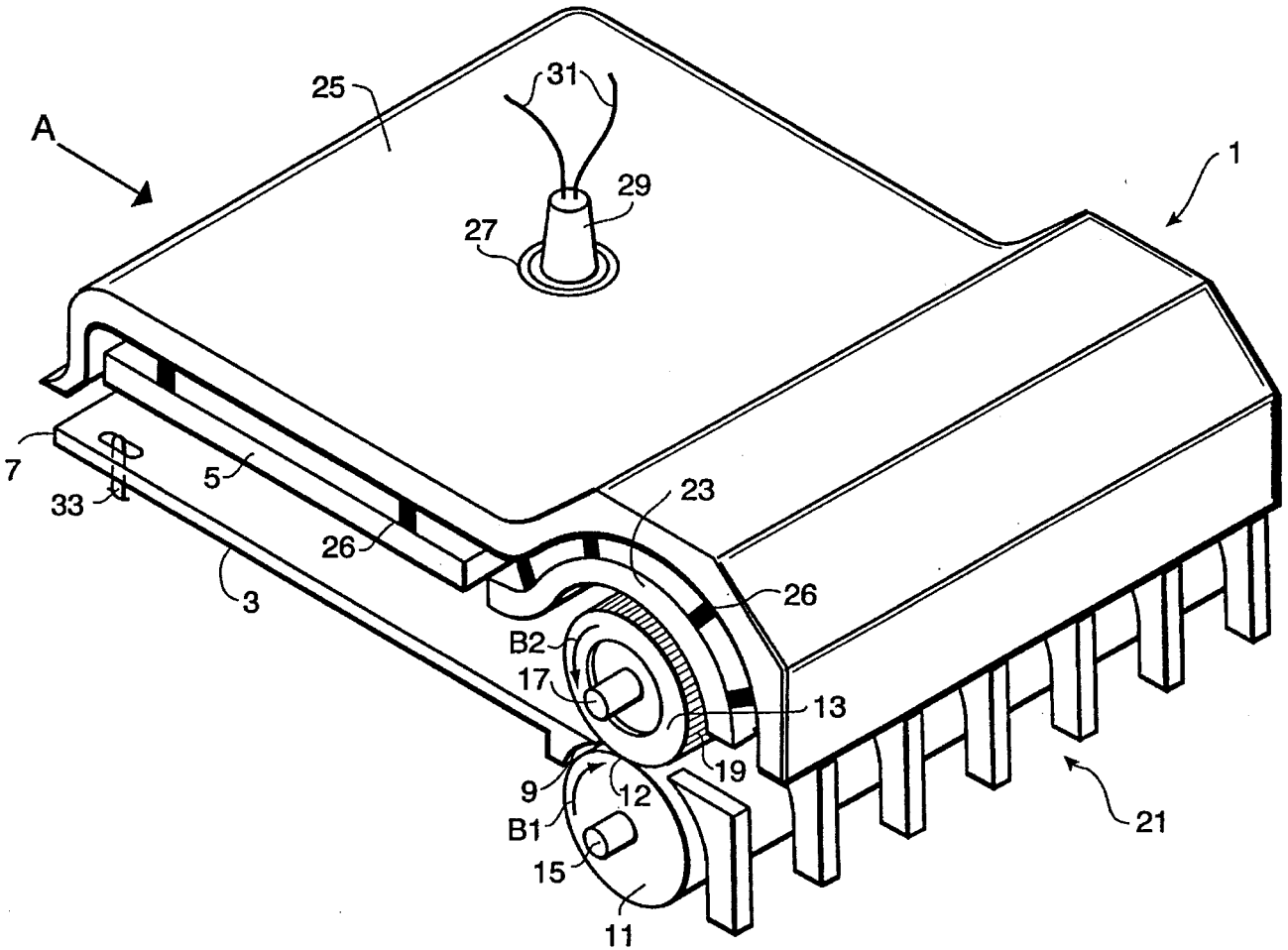
FIG. 1 is a schematic, perspective view of the apparatus of the present invention.

The drawings referred to in this description should be understood as not being drawn to scale except if specifically noted.

DETAILED DESCRIPTION OF THE INVENTION

Reference is made now in detail to a specific embodiment of the present invention, which illustrates the best mode presently contemplated by the inventor(s) for practicing the invention. Alternative embodiments are also briefly described as applicable.

The fusion heater apparatus 1 of the present invention is depicted in FIG. 1. While the fusion heater apparatus 1 is designed to have an inherent operational life coequal to the hard copy machine in which it is resident, it is also designed as an integrated, replaceable unit, adapted to fit into a complementary bed or housing of the hard copy machine (not shown).

A print media support table 3 is generally aligned within the machine to receive a newly developed print medium (hereinafter an exemplary sheet of paper) bearing the "wet" toner or ink image. The paper path is generally depicted as arrow A. A thermoplastic material, such as polysulfone, has been found to make a suitable support table 3 because of its heat resistance.

A planar heater plate 5 is disposed above the support table 3. The gap "a" between the support table 3 and heater plate 5 may be adjusted in design to the particular hard copy machine in which the fusion heater apparatus 1 is used; that is, the thermal transfer requirement may vary between wet toner, dry toner, or ink machines. In the preferred embodiment, for example in a liquid electrophotography laser printer, gap "a" is approximately 0.30 inch.

With the paper entering the fusion heater apparatus 1 along path A at front end 7 of the support table 3, a pair of rollers 11, 13 are located at the opposite end 9 of the support table 3. The rollers 11, 13 form a nip 12 where they contact each other. The lower pinch roller 11 (with specified locations and directions obviously being relative to the mounting of the fusion heater apparatus 1 in the hard copy machine), mounted on axle 15, is made of a relatively hard rubber, such a silicone or high temperature polyurethane. The upper roller 13, designated in this embodiment as a pressure roller 13, mounted on axle 17, is a relatively thick-walled metal roller having a PTFE coating 19 that provides a low friction surface.

The pressure roller 13 has its axle coupled to a drive motor (not shown) in a suitable manner as would be known in the art. The drive motor and accompanying electronic controls are configured to rotate the pressure roller 13 and, therefore, the follower pinch roller 11, in the direction of arrows B1 and B2. The nip 12, upon catching the leading edge of the paper, would therefore pull the paper onward across the support table 3 along path A.

Downstream in paper path A of the rollers 11, 13, a set of standard paper separation claws 21 are provided.

A roller heater 23 is disposed above the pressure roller 13. The roller heater 23 has a generally curved, hemispherical cross-section to follow the radius of curvature of the pressure roller 13 with a larger radius of curvature so as to partially encompass the pressure roller 13.

An insulating member 25 overlays the heater elements 5, 23 using standoffs 26. The insulating member 25 thus forms a shield for other components of the hard copy machine from the heat produced by the heater elements 5, 23 and to help retain the heat generated to the support table 3 and pressure roller 13 where the image fusion process occurs. In the preferred embodiment, the shield 25 is made of a high temperature engineering thermoplastic. An aperture 27 is provided in the shield 25. The aperture 27 is adapted to receive an electrical connector 29 for the heater elements 5, 23. The connector 29 is coupled to a power supply and control electronics (not shown) via leads 31.

A detector 33, such as a microswitch or an optical detector as would be known in the state of the art, is adapted to detect paper presence and absence from front end 7 of the support table 3. That is, the detector 33 senses the leading and trailing edges of the paper as they pass by it. The signal is used to cycle the heater elements 5, 23 on and off.

As will be recognized by those skilled in the art, the fusion heater apparatus 1 as defined above is easily adapted to a cartridge-type shell (not shown) for unitary replacement in a hard copy machine. Electronic controls and power supply current for the heaters can be provided in a manner as would be commonly known in the art for coupling to the cartridge components appropriately.

Referring now to FIGS. 2A and 2B, the planar heater plate 5 is shown to be a laminated or other sandwich-like construction. The top layer 201—that which will be distally located from a sheet of paper traversing through the apparatus—of the plate 5 is an insulative support member. In the preferred embodiment, the top layer 201 is made of mica. The thickness of the mica is in the range of approximately 0.050 to 0.250 inch.

Subjacent this insulative support member 201 is a heat sink layer 203 of metal, such as aluminum. The heat sink 203 has a thickness in the range of approximately 0.050 to 0.150 inch.

Subjacent the heat sink 203 is the heater 205 having heating element(s) 207 within. Planar heaters are commercially available from Watt Low Heaters. The heating element(s) 207 are connected to the electrical connector 29 (FIG. 1) via wires, or wires and an electrical socket 209, through the shield 25 and insulative support member 201 as would be known in the art.

Subjacent the heater 205 is a heat transfer layer 211. In the preferred embodiment, the heat transfer layer 211 is an aluminum, serrated plate 211, having a thickness in the range of approximately 0.050 to 0.150 inch. This heat transfer plate 211 has grooves 213 only on the surface facing a sheet of paper 215 as it moves along its transport path in the direction of arrow A. It has been found that the grooved surface provides a better heat transfer to the paper 215 due to the increased heat transfer surface area so created.

The curved, pressure roller heater 23 of the fusion heater apparatus 1 has the same cross-section sandwich configuration as the planar heater 5.

Referring now to FIGS. 3 and 4, a roller nip pressure adjustment device 301 and its method of operation are depicted. A plate member 303 is disposed to receive the axles 15, 17 of the rollers 11, 13. The plate member 303 is provided with an elongated slot aperture 305 for receiving axle 15 of pinch roller 11. The end 315 of axle 15 protruding through the elongated aperture 305 is free to slide toward and away from the plane of the axle 17 of pressure roller 13. The axle 15 should be free to rotate in the aperture 305 but have substantially no freedom of motion parallel to said plane of the pressure roller axle 17. The pressure roller axle 17 protrudes through another plate member aperture 307 which is sized to permit the pressure roller axle 17 to rotate in its drive plane but otherwise not have any other substantial freedom of movement.

A pressure adjustment lever 317 is mounted for rotation about pivot mount 319 on plate member 303. A lever member 317 is used to adjust the pressure in the nip 12 between the two rollers 11, 13. As more clearly depicted in FIGS. 4A and 4B, the lever 317 has a handle portion 321 and a camming portion 323. The camming portion 323 has a cam surface 325 in contact with the protruding axle 15 at axle end 315. The camming surface 325 is provided with a series of lock notches 327. As the lever 317 is rotated (manually or in an automated fashion as would be known in the art) in the direction of arrow C, axle 315, having freedom of motion along the elongated slot aperture 305, is moved by the camming surface 325 from notch-to-notch. Each lock notch 327 puts the center of axle 15 a different distance from the pivot mount 319 (e.g., "$d_x$" as shown in FIG. 4A and "$d_y$" as shown in FIG. 4B, where $d_x<d_y$).

The result of moving the lever 317 from notch-to-notch is depicted in FIGS. 4C and 4D. With the lever 317 in the position as shown in FIG. 4A, the camming surface 325 and lock notch 327 is configured to allow the roller axle 11 to be at its lowest position in slot aperture 305. The pivot point 319 and center of rotation of axle 15 at end 315 are separated by a distance designated $d_x$. Looking to FIG. 4C, the pinch roller 11 center of rotation and pressure roller 13 center of rotation are separated by a distance $g_x$. The pressure between the rollers 11, 13 at the nip 12 in this position is at least a predetermined minimum pressure necessary to grab the heaviest/thickest media, such as envelopes, that the hard copy machine is designed to handle, yet without damage to the media as it is transported through the roller nip 12. Now if the lever 317 is moved in the direction of arrow C in FIG. 4A to the position shown in FIG. 4B, the axle center of rotation to pivot point distance is $d_y$, by appropriate design greater than $d_x$. Correspondingly, as seen in FIG. 4D, pinch roller 11 has been moved such that the pinch roller 11 center of rotation and pressure roller 13 center of rotation are separated by a distance $g_y$, where $g_y$ is less than $g_x$. Therefore, at the nip 12 there will be a greater pressure between the pinch roller 11 and the pressure roller 13. This higher pressure is designed to handle thinnest, lightest, or slippery media, such as transparencies. In other words, the nip pressure is at its predetermined maximum. The camming surface 325 and plurality of lock notches 327 are designed to create appropriate pressures at the nip 12 for each type of media.

Note here that the adjustment device 301 may be part of the hard copy machine to which the fusion heater apparatus 1 is adapted or be part of a housing or shell in a replaceable, unitary cartridge form apparatus I as previously described.

Referring back to FIG. 1, in operation, a transport mechanism (not shown) of a hard copy printing machine delivers a printed but still "wet" sheet of paper to the fusion heater apparatus 1 of the present invention as represented by arrow A.

The pressure adjustment device 301 has been used to set the nip pressure appropriate to handle the particular media being printed.

Paper presence is detected as soon as the leading edge of the paper trips the detector 33. With the paper detected, the machine electronics (not shown) activates the heaters 5, 23.

Note that different print dyes may be fixed at different temperatures. Electronic controls as would be known in the art may be provided to vary the maximum temperature achieved by the heaters 5, 23 to adapt the hard copy machine to different print dyes.

The machine transport pushes the paper onto and across the support table 3 until the leading edge is grabbed in the roller nip 12. As the paper passes across the support table 3 and through the nip 12, heat is transferred first from the heat transfer plate 211 of the heater 5 and secondly from the pressure roller PTFE layer that has been heated by the supplemental roller heater 23. When the sheet of paper exits the nip 12 over the separation claws 21, the image is completely fixed on the paper and may be handled immediately.

When the detector 33 senses the trailing edge of the medium, a signal to the electronics cuts the power to the heaters 5, 23. A delay can be employed to allow for a gap between sheets of paper to avoid unnecessary cycling of the heaters 5, 23.

The foregoing description of the preferred embodiment of the present invention has been presented for purposes of illustration and description. It is not intended to be exhaustive or to limit the invention to the precise form disclosed. Obviously, many modifications and variations will be apparent to practitioners skilled in this art. Similarly, any process steps described might be interchangeable with other steps in order to achieve the same result. The embodiment was chosen and described in order to best explain the principles of the invention and its best mode practical application to thereby enable others skilled in the art to understand the invention for various embodiments and with various modifications as are suited to the particular use contemplated. It is intended that the scope of the invention be defined by the claims appended hereto and their equivalents.

What is claimed is:

1. A thermal energy transfer apparatus for fusing print dye to a print medium in a hard copy producing machine, having a means therein for applying print dye to said medium, a first transporting means, downstream of said means for applying print dye to said medium, for transporting said print medium such that a leading edge of said print medium is transported into said thermal energy transfer apparatus, an electrical power supply, control means for operating said machine, and means for connecting said thermal energy transfer apparatus to said power supply and said control means, said apparatus comprising:

supporting means for supporting the print medium in a first plane as said medium is transported by said first transporting means;

detecting means disposed with respect to said supporting means for generating a first signal indicative of print medium presence on said supporting means when a leading edge of said medium is transported onto said supporting means by said first transporting means and a second signal indicative of print medium absence when a trailing edge of said medium passes said detecting means;

second transporting means disposed with respect to said supporting means for receiving the leading edge of said medium and transporting said medium across said supporting means and out of said apparatus;

first radiant heating means, disposed adjacent said first plane of said supporting means in a second plane parallel thereto and separated therefrom by a predetermined gap, and connected to said power supply, for transferring heat across said gap to said print medium in response to said first signal and prior to said medium leading edge reaching said second transporting means.

2. The apparatus as set forth in claim 1, wherein said second transporting means comprises:

a first roller, and a second roller forming a nip with said first roller.

3. The apparatus as set forth in claim 2, further comprising:

second heating means, mounted adjacent said first roller, for heating a surface of said first roller.

4. The apparatus as set forth in claim 2, further comprising:

adjusting means, disposed with respect to said first roller and said second roller, for selectively adjusting nip pressure between said rollers.

5. The apparatus as set forth in claim 1, wherein said first heating means comprises:

a planar laminate having:

i. a first layer, proximate said supporting means, for transferring heat toward said supporting means; and ii. a second layer, superjacent said first layer, for selectively applying thermal energy to said heating means.

6. The apparatus as set forth in claim 5, wherein said planar laminate further comprises:

a third layer, superjacent said second layer, for supporting said first and second layers.

7. The apparatus as set forth in claim 6, wherein said third layer of said laminate further comprise:

a. a metal layer, superjacent said second layer, and b. a structural layer superjacent said metal layer.

8. The apparatus as set forth in claim 5, wherein said first layer further comprises:

a layer of thermally conductive material, having a surface having elongated, parallel grooves thereon facing said supporting means.

9. The apparatus as set forth in claim 3, wherein said second heating means comprises:

a curved laminate, having a radius of curvature greater than that of said first roller, having:

i. a first layer, proximate said first roller, for transferring heat to said supporting means;

ii. a second layer, superjacent said first layer, for selectively applying thermal energy to said second heating means; and iii. a third layer, superjacent said second layer, for supporting said first and second layers.

10. The apparatus as set forth in claim 9, wherein said third layer of said laminate further comprise:

a. a metal layer, superjacent said second layer, and b. a structural layer superjacent said metal layer.

11. The apparatus as set forth in claim 10, wherein said first layer further comprises:

a layer of thermally conductive material, having a surface, facing said supporting means, having elongated, parallel grooves thereon.

12. The apparatus as set forth in claim 1, further comprising:

a shielding means, superposing said first heating means, for substantially insulating said machine from thermal energy generated by said first heating means.

13. The apparatus as set forth in claim 3, further comprising:

a shielding means, superposing said first heating means and said second heating means, for substantially insulating said machine from thermal energy generated by said first and second heating means.

14. The apparatus as set forth in claim 1, wherein said first heating means is turned on in response to said first signal from said detecting means and turned off in response to said second signal from said detecting means.

15. The apparatus as set forth in claim 3, wherein said first heating means and said second heating means are turned on in response to said first signal from said detecting means and turned off in response to said second signal from said detecting means.

16. In combination with a hard copy machine, an apparatus for drying print dye on a print medium bearing said print dye on at least portions of a surface thereof, comprising:

a substantially planar print medium support for receiving said print medium bearing said print dye from said machine;

a substantially planar heater adjacent said support, having a surface area at least as large as said print medium, adapted to transfer heat passively to the surface of said print medium bearing said print dye across a gap between said heater and said print medium; and a mechanism for moving said print medium across said support and out of said apparatus.

17. The apparatus as set forth in claim 16, further comprising:

an auxiliary heater for heating an external surface of said mechanism for moving said print medium such that heat is applied to said print medium from said mechanism for moving said print medium.

18. The apparatus as set forth in claim 16, further comprising:

a mechanism for turning said planar heater on in response to said support receiving said print medium and off in response to said mechanism for moving said print medium removing said print medium from said support.

19. The apparatus as set forth in claim 17, further comprising:

a mechanism for turning said planar and said auxiliary heaters on in response to said support receiving said print medium and off in response to said mechanism for moving said print medium removing said print medium from said support.

20. An apparatus for drying print dye on a print medium, comprising:

a. a substantially planar supporting means for receiving said print medium bearing print dye on a surface area thereof;

b. a substantially planar heating means, having a thermal transfer surface juxtaposed with respect to said supporting means such that heat is transferred from said heating means to said surface area of said print medium across a gap between said supporting means and said heating means;

c. pinch roller means, adjacent said supporting means, for receiving said print medium and transporting said print medium off said supporting means.

21. The apparatus as set forth in claim 20, further comprising:

an auxiliary heating means, adjacent said pinch roller means, for heating a surface of said pinch roller means.

22. The apparatus as set forth in claim 20, further comprising:

a detecting means, adapted to provide a signal to activate said heating means when a print medium is present on said supporting means and to deactivate said heating means when a print medium is absent from said supporting means.

* * * * *